US005758438A

United States Patent [19]

Crowell

[11] Patent Number: 5,758,438

[45] Date of Patent: Jun. 2, 1998

[54] PRINTING SYSTEM AND METHOD FOR INDIVIDUALLY CREATING THREE-DIMENSIONAL DISPLAYS

[76] Inventor: Christopher S. Crowell, 80 Plains Rd., Essex, Conn. 06426

[21] Appl. No.: 568,172

[22] Filed: Dec. 6, 1995

[51] Int. Cl.[6] ..... G09F 1/00

[52] U.S. Cl. ..... 40/124.08; 40/124.11; 40/539; 283/117

[58] Field of Search ..... 40/124.1, 124.01, 40/124.08, 124.09, 124.11, 124.16, 539; 283/117

[56] References Cited

U.S. PATENT DOCUMENTS

| | | | |
|---|---|---|---|
| 2,106,153 | 1/1938 | Mull | 40/124.1 |
| 2,884,738 | 5/1959 | Lohnes et al. | 40/124.1 X |
| 4,146,983 | 4/1979 | Penick et al. | 40/124.1 |
| 4,349,973 | 9/1982 | Penick et al. | 40/124.1 |
| 4,763,427 | 8/1988 | Schrager | 40/124.1 |
| 4,867,480 | 9/1989 | Volkert | 40/124.1 X |
| 5,022,681 | 6/1991 | Penick | 40/124.1 X |
| 5,383,292 | 1/1995 | Whittredge | 40/124.1 |
| 5,548,913 | 8/1996 | Randolph et al. | 40/124.1 X |

*Primary Examiner*—Brian K. Green
*Attorney, Agent, or Firm*—Melvin I. Stoltz

[57] ABSTRACT

By providing a three-dimensional, pop-up or mechanical image forming member in planar form removably mounted to a carrier, and constructed for being easily removed therefrom and assembled or mounted with a card or display member, a completely integrated three-dimensional, pop-up or mechanical image generating system is attained enabling individuals, and small businesses to produce pop-up, three-dimensional, or mechanically-activated displays, bags, characters, greeting cards, stationery, advertising literature, and the like, that is equivalent in quality and visual presentation to commercially produced material. Preferably, a plurality of different three-dimensional, pop-up, and/or mechanical image forming members are provided with each incorporating a message receiving zone in which any desired message can be printed by the user. By employing the system of the present invention, any individual or small business is able to produce visually distinctive, eye-catching, and interest-generating three-dimensional, pop-up, and/or mechanical displays, bags, characters, greeting cards, stationery, advertising literature, books, promotional material, and the like using a conventional computer and printer, which incorporate any specific desired message printed thereon.

8 Claims, 9 Drawing Sheets

Fig. 1
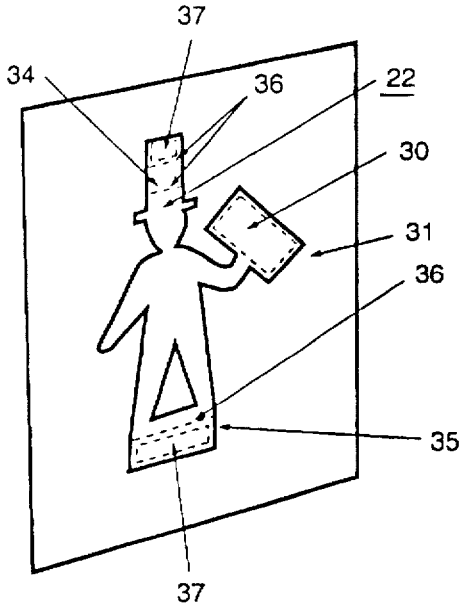
Fig. 2
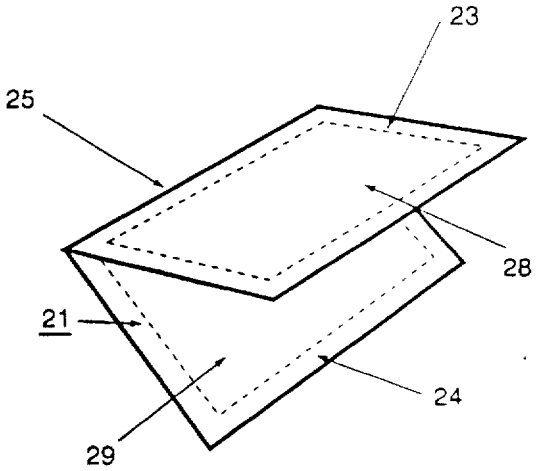
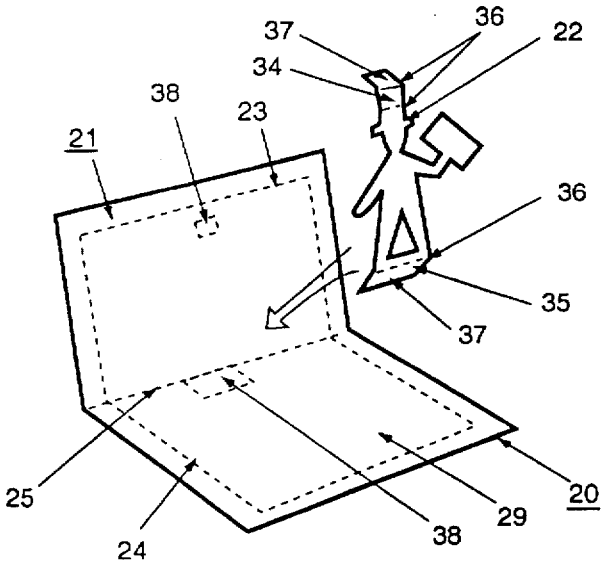
Fig. 3
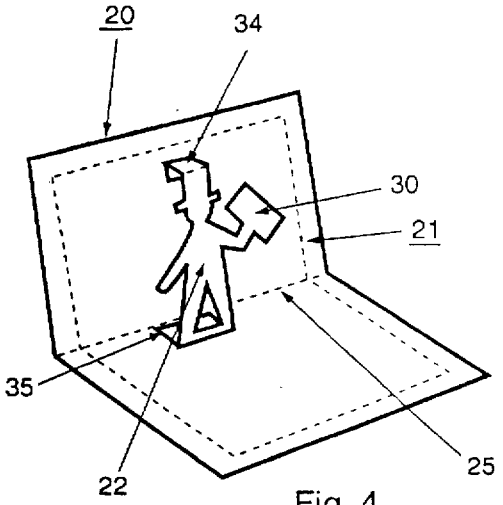
Fig. 4

Fig. 5
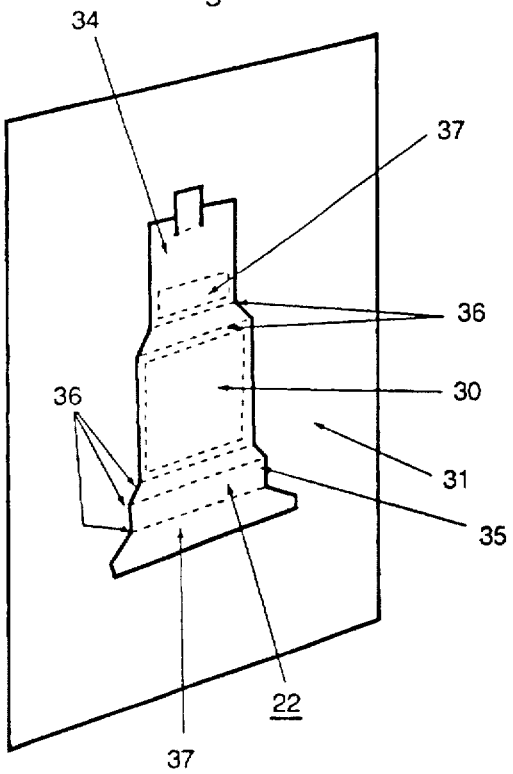
Fig. 6
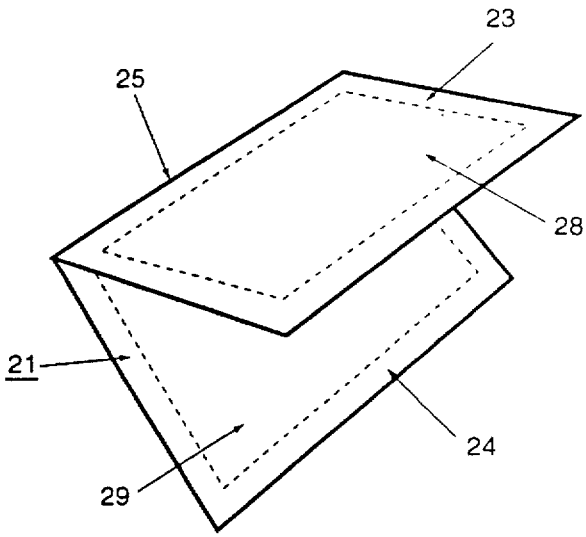
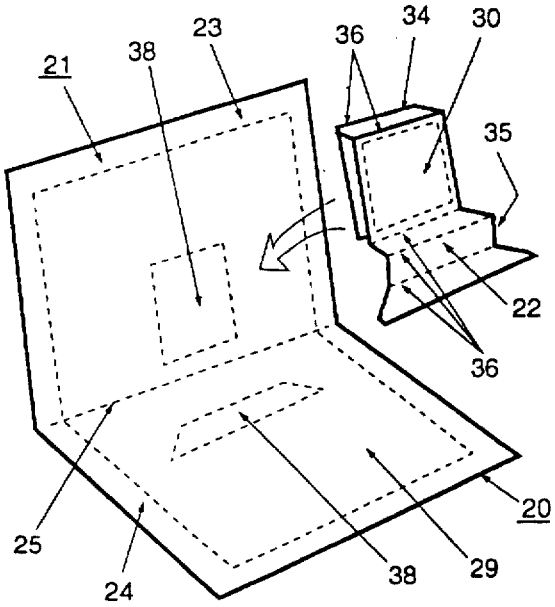
Fig. 7
Fig. 8
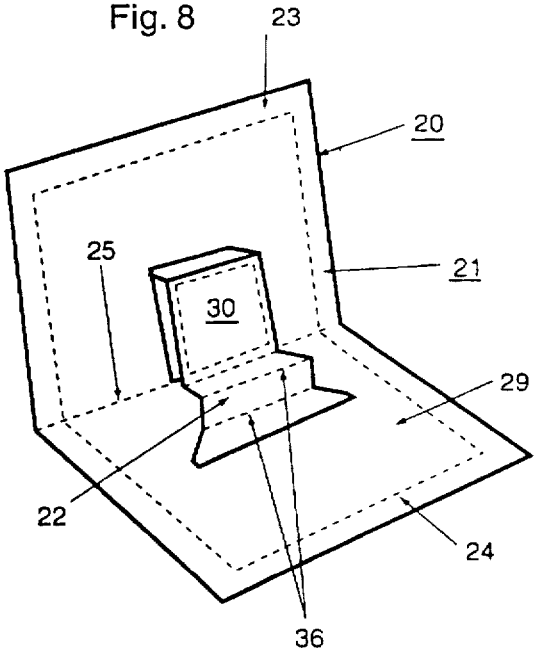

Fig. 9
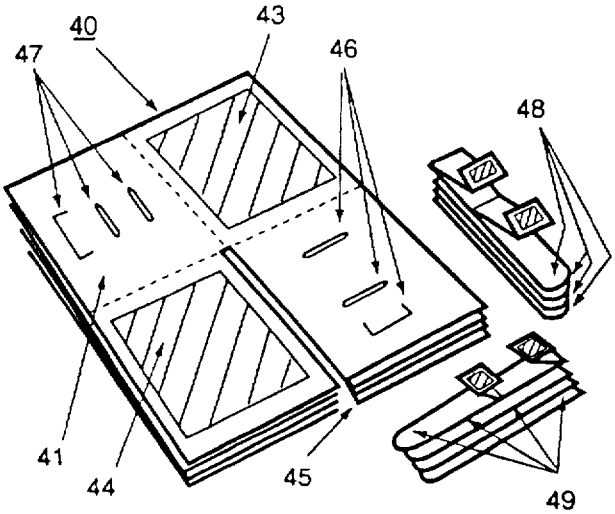
Fig. 10
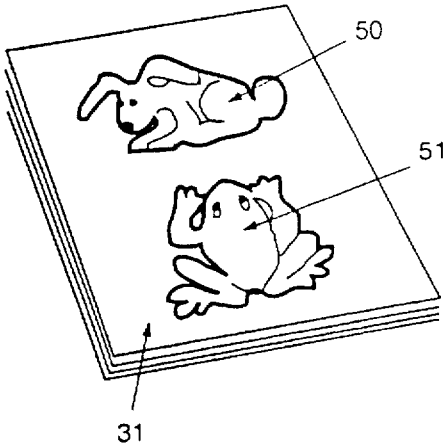
Fig. 11
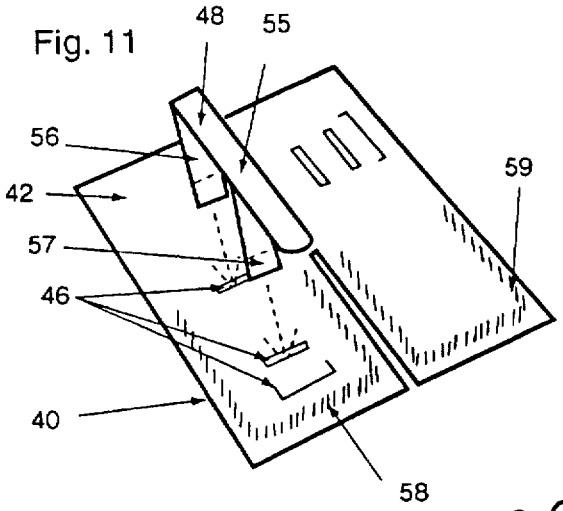
Fig. 12
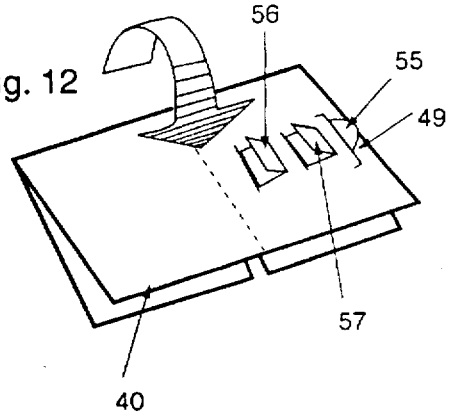
Fig. 13
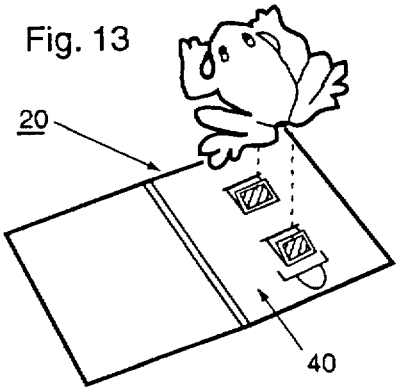
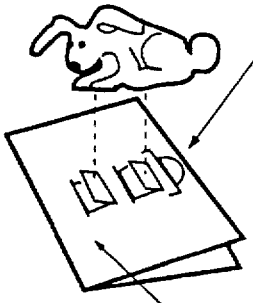
Fig. 14
Fig. 15
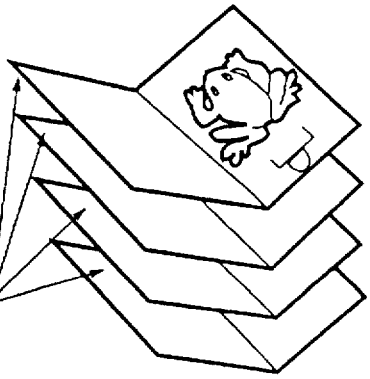

PRINTING SYSTEM AND METHOD FOR INDIVIDUALLY CREATING THREE-DIMENSIONAL DISPLAYS

TECHNICAL FIELD

This invention relates to three-dimensional, pop-up, and mechanically activated printed material and, more particularly, to an integrated system and assembly method which enables individuals and small businesses to produce three-dimensional, pop-up, and mechanically activated materials using personal computers and printers.

BACKGROUND ART

Commercially printed material has been important to individuals for both personal use and business use. On a personal level, the use of commercially generated greeting cards is one prime example of a quality product at a reasonable price, while small businesses employ commercial printers to attain quality promotional and advertising material tailor-made to their requirements. Unfortunately, the cost of these commercially generated products has increased substantially in recent years, forcing customers to seek alternate sources for this material.

With the continuously expanding field of home computers and higher quality printers, various systems have been developed which enables individuals to create their own print material using conventional paper or other flat printing stock. Depending upon the quality of the computer system and printer available to an individual, the individually created print material is able to approach the general quality of the material commercially available. However, although individuals have been able to produce printed material having a quality comparable to commercial products, individuals have been limited to being only able to produce flat, two-dimensional material.

Although substantial advances have been made to enable individuals and small businesses to attain high quality print material using their own personal computers and printers, no system has been developed which allows individuals or small businesses to expand beyond flat, two-dimensional printed material. In spite of the desirability of attaining the substantially increased visual impact provided by three-dimensional, pop-up, or mechanically activated printed material, no system presently exists which enables the independent, self-creation of such pop-up, mechanical, or three-dimensional displays, cards, or promotional materials.

One principal reason for this prior art failing is due to the stringent requirements for die cutting every element employed in pop-up, three-dimensional, or mechanically activated works. As a result, individuals have been incapable of producing pop-up, three-dimensional, or mechanically activated material which is equivalent to the commercially available images or products. Although substantial use of cut-outs or pre-punched components have been employed in various preprinted products, these products are incapable of providing the visual representation obtained by commercially produced three-dimensional artwork, three-dimensional pop-ups, or mechanically-activated media.

In addition to the requirement for the pop-up, three-dimensional, or mechanically activated elements to be die-cut, in order to attain a product consistent with commercial quality, precise positioning, complicated folding techniques, and secure affixation in gluing are also often required. In view of these factors, individually created, mechanically activated material and three-dimensional material for pop-up stationery, cards, advertisements, business information, books, and the like have not been capable of being independently generated by individuals or small businesses.

Therefore, it is a principal object of the present invention to provide a fully integrated printing system and assembly method which enables individuals and businesses to achieve self-created print material which incorporates pop-up, three-dimensional, or mechanically activated indicia associated therewith.

Another object of the present invention is to provide an integrated printing system and assembly method having the characteristics and features described above which can be easily achieved by employing any personal computer and quality printer.

Another object of the present invention is to provide an integrated printing system and assembly method having the characteristics and features described above which is capable of enabling the user to print any desired message on components which are subsequently employed to form pop-up, three-dimensional, or mechanically activated elements in the final print material.

Other and more specific objects will in part be obvious and will in part appear hereinafter.

SUMMARY OF THE INVENTION

By employing the present invention, all of the difficulties and drawbacks of the prior art have been eliminated and a completely integrated three-dimensional or mechanically activated image generating system is attained enabling individuals, and small businesses to produce pop-up, three-dimensional, or mechanically activated greeting cards, advertising literature, books, stationery, bags, objects, characters, displays, or promotional material that is equivalent in quality and visual presentation to commercially produced material. By employing the system of the present invention, the components incorporated therein, and the unique process defined thereby, any individual or small business is able to produce visually distinctive, eye-catching, and interest-generating three-dimensional, pop-up and mechanically activated display material, such as greeting cards, stationery, books, advertising literature, bags, objects, characters, promotional material, and the like, usable for any desired purpose, such as direct mail, flyers, magazine inserts, sales brochures, premiums, point of purchase displays, packaging, correspondence, and gift-giving.

By employing the present invention, an individual is able to select the particular three-dimensional, pop-up, or mechanical image or format desired, create a print message to be included on the selected three-dimensional, pop-up, or mechanical image, produce the three-dimensional, pop-up, or mechanical image with the desired message or artwork printed thereon, and then assemble the three-dimensional image or customer-generated art with the message printed thereon, as well as on the support material associated therewith. Prior to the present invention, no system was capable of enabling any individual to attain a product of this nature without incurring the high costs of specialized commercial printing.

By employing the present invention, any individual or small business having a conventional, state-of-the-art personal computer and a high quality laser printer or dot matrix printer is now able to produce high quality, three-dimensional, pop-up, or mechanically activated displays, such as greeting cards, stationery, advertising material, books, bags, objects, characters, promotional brochures, etc. which are equivalent in appearance and quality to products previously attainable only from commercial printers or distributors. If desired, the printer may comprise a color printer, in order to further enhance the visually pleasing images produced. However, the use of a color printer is not required to employ the present invention.

In using the integrated, three-dimensional, pop-up, and mechanical image generating system of the present invention, a user is provided with a plurality of preformed, three-dimensional, pop-up, and/or mechanically activated display images, graphics, layouts, printed or unprinted blanks, etc., which have been precut, using conventional die-cutting techniques required to attain high quality results. The three-dimensional, pop-up and mechanical images are retained on carrier sheets, preferably formed as an 8½"×11" sheet for ease of transport through conventional printers. However, other sizes can be employed without departing from the scope of the present invention.

In addition to providing three-dimensional, pop-up, and mechanical images arranged in a planar form on a suitable carrier, each three-dimensional, pop-up, and mechanical image also may incorporate adhesive means, tabs, slots, glue, tape, etc., formed thereon, along with any requisite support tabs or holding arms for use in the placement, positioning, and securement of the three-dimensional, pop-up, and mechanical image to a display carrier in those embodiments in which the three-dimensional, pop-up, and mechanical image cooperates to provide the desired visual effect. In addition, other securement systems can be employed, such as tabs and slots cooperatively associated therewith to achieve the desired unique and striking visually distinctive product.

In the present invention, the user employs a conventional personal computer in a manner similar to conventional print software presently popular and well known in the art. In this instance, by employing the software associated with the three-dimensional, pop-up, and mechanical image generating system of this invention, the use and printing of different three-dimensional, pop-up, and mechanical images is easily achieved.

In employing the present invention, a user selects the desired three-dimensional, pop-up, or mechanical image, graphic, layout, etc. from the collection of available options, based upon the visual impact desired and the particular message to be printed thereon. In each instance, the three-dimensional, pop-up, or mechanical image comprises an unassembled, planar, die-cut member removably affixed to a flat carrier sheet, which may be partially printed or blank for a complete self-designed result.

In the next step, the user identifies the selected image on the personal computer using the associated software and, then, using the word processing capabilities of the personal computer, the user inputs into the computer the particular message or graphic image to be printed on the three-dimensional, pop-up, or mechanical image.

Once the desired message has been composed, along with any other additional graphics or indicia desired to be printed on the three-dimensional, pop-up, or mechanical image-forming member, the three-dimensional, pop-up, or mechanical image forming member and associated carrier sheet are set on the printer for passage therethrough. The system is then activated, causing the desired message and associated graphics to be transferred directly onto the three-dimensional, pop-up or mechanical image forming member in the specific designated zone thereof.

Once the precisely desired message and additional images or indicia have been printed onto the three-dimensional, pop-up, or mechanical image-forming member in the appropriate zones designated therefor, the three-dimensional, pop-up, or mechanical image-forming member is removed, pealed, or punched out from the carrier sheet, ready for assembly.

In those embodiments in which the three-dimensional printed display incorporates a support member, the user creates a desired image holder or support member on which additional information is presented in the generally conventional manner well known in the art. As an example, the image holder or support member may comprise a greeting card, formed by a single folded sheet of paper, or heavier stock, upon which any desired message is printed. In addition, a single sheet of stationery, advertising material, book, promotional brochure, etc. can be employed as the image holder/support member. In each instance, however, further impact and excitement is attained by incorporating the three-dimensional, pop-up, or mechanical image member therewith.

Once both the image holder/support member and the three-dimensional, pop-up or mechanical image have been fully printed in the desired manner, the three-dimensional, pop-up, or mechanical image forming member is assembled or folded, in the manner designated thereon and, where applicable, is secured to the image holder/support member in the precise locations designated in the accompanying instructions. In order to provide ease of assembly, the three-dimensional, pop-up, and mechanical image forming member preferably incorporates adhesive means, tabs, slots, etc., to enable the three-dimensional, pop-up, and mechanical image forming member to be quickly and easily fully assembled or, where required, easily affixed to the image holder/support member for integrated cooperation therewith.

By employing the present invention, any individual or small business having a computer and printer is capable of producing commercial quality three-dimensional, pop-up, and mechanical products, each of which are personalized as desired by the user. As a result, any greeting card, stationery, book, business or calling card, folder, display item, container, bag, object, character, design, promotional material, advertising literature, etc., for personal delivery, direct mail, store displays, premiums, invitations, announcements, and the like, are all easily created with eye-catching, interest-generating three-dimensional, pop-up, or mechanically activated displays associated therewith.

Furthermore, users are able to personalize not only the card, image holder, or display member upon which the three-dimensional, pop-up, or mechanical member is mounted, but are also able to produce three-dimensional, pop-up, and mechanical displays wherein the three-dimensional, pop-up, or mechanical image display member itself incorporates personalized information. In addition, complete assembly ease is achieved by incorporating die cuts, tabs, slots, adhesive zones and placement marks where required. Prior to the present invention, individualized or personalized three-dimensional, pop-up, or mechanical displays having these characteristics were incapable of being achieved.

The invention accordingly comprises the features of construction, combinations of elements and arrangement of parts which will be exemplified in the constructions hereinafter set forth, as well as the several steps and the interrelationship of such steps with respect to each other, which are exemplified in the following detailed disclosure and the scope of the invention will be indicated in the claims.

THE DRAWINGS

For a fuller understanding of the nature and objects of the invention, reference should be had to the following detailed description taken in connection with the accompanying drawings in which:

FIG. 1 is a perspective view of one three-dimensional, pop-up, image generating member pre-cut and supportingly maintained on a suitable carrier;

FIG. 2 is a perspective view of a printed card or holder for use in cooperation with the three-dimensional, pop-up member;

FIG. 3 is an exploded perspective view of the three-dimensional member removed from the carrier, ready for assembly to the printed card;

FIG. 4 is a perspective view of the fully assembled three-dimensional printed display, in the form of a pop-up member and card;

FIG. 5 is a perspective view of an alternate embodiment of the three-dimensional, pop-up, image generating member, pre-cut and supportingly maintained on a suitable carrier;

FIG. 6 is a perspective view of a printed card or holder for use in cooperation with the three-dimensional, pop-up member;

FIG. 7 is an exploded perspective view of the three-dimensional, pop-up member removed from the carrier, ready for assembly with the printed card;

FIG. 8 is a perspective view of the fully assembled, three-dimensional, printed display in the form of a pop-up member and card;

FIG. 9 is a perspective view of a plurality of pre-formed sheets and activating arm assemblies employable in constructing a mechanically activated printed display in accordance with the present invention;

FIG. 10 is a perspective view of a plurality of carrier sheets incorporating thereon removable members forming the mechanically activated components of the printed display;

FIGS. 11–14 are all perspective views depicting the mechanically activated printed display of FIG. 9 and 10 in different stages of assembly;

FIG. 15 is a perspective view of a plurality of the mechanically activated printed displays assembled to form a book;

DETAILED DESCRIPTION

Figure 16:
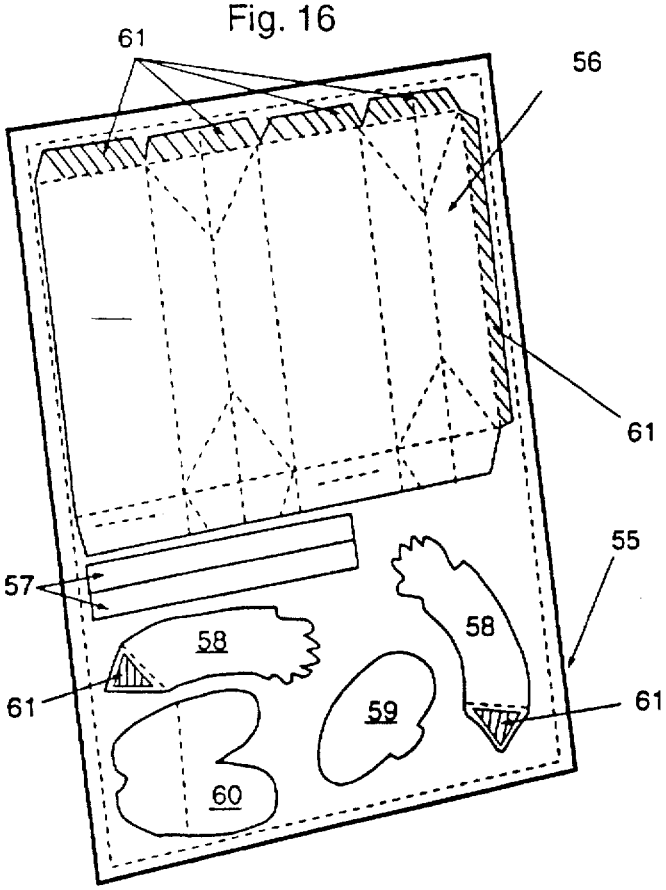
FIG. 16 depicts an alternate embodiment of a three-dimensional printed display of the present invention wherein a carrier sheet incorporates all of the requisite components for forming a unique, three-dimensional bag or container constructed as a character.

By referring to FIGS. 1–38, along with the following detailed disclosure, the overall construction and operation of the present invention can best be understood. For purposes of fully detailing the present invention and providing the best mode for carrying out the present invention, several different embodiments of individually produced, three-dimensional printed image displays of this invention are depicted in FIGS. 1–36. However, it is to be understood that the embodiments depicted in FIGS. 1–36 are presented for exemplary purposes only, and are not intended as a limitation of the present invention to these particular embodiments. As is evident from this disclosure, the present invention can be employed with numerous alternate constructions, all of which are within the scope of the present invention.

In the embodiments depicted in FIGS. 1–8, individually produced, three-dimensional printed display 20 comprises, when fully assembled in its final form, printed card 21 and three-dimensional or pop-up member 22 securely affixed thereto. Three-dimensional or pop-up member 22 is affixed to portions of printed card 21 in a manner which causes three-dimensional member 22 to be folded whenever card 21 is folded, and then automatically self-erected into a three-dimensional pop-up configuration whenever printed card 21 is open. This overall construction is well known in the prior art and has been employed in numerous alternate configurations in numerous commercially generated products. However, by employing the present invention, three-dimensional printed display system 20 is attained for the first time with individualized indicia and messages formed on both printed card 21 and three-dimensional member 22.

In the embodiments depicted, printed card 21 comprises a front panel 23 and a rear panel 24. Panels 23 and 24 are integrally attached to each other along a single fold line 25.

In this way, panel 23 is capable of arcuate pivoted movement relative to panel 24 along the axis defined by fold line 25.

As in well known in the prior art, panel 23 of printed card 21 incorporates a message zone 28 formed on the front surface thereof, comprising the entire front surface, if desired. In addition, rear panel 24 incorporates a message zone 29 which, if desired, may comprise substantially the entire forward facing surface of rear panel 24.

By employing message zones 28 and 29, any individual or small business owner is capable of printing, any desired message or indicia in these zones in order to provide a card specially constructed for a particular purpose. As previously disclosed, printed card 21 can be constructed as a business or calling card, folder for advertising material, sales aid, self-promotional product, greeting card, holiday card, invitation, special announcement card, or any other information delivering construction sought by the user.

Regardless of the purpose for which printed card 21 is employed, printed card 21 is constructed in a manner completely consistent with the requirements of the user with the precisely desired information, indicia, figures, etc. desired by the user contained thereon. Furthermore, in order to further enhance the excitement, interest, and attractiveness of printed card 21, the user may employ color printing, color foil material, etc. as additional elements for improving the attractiveness and excitement and interest sought to be generated by printed card 21.

Although the rear surface of panel 23 and the rear surface of panel 24 is typically not employed for containing printed information, a user is capable of producing printed card 21 with any surface of any panel member containing the desired information. Consequently, if desired, these other surfaces can also be employed for delivering the desired message to the consumer.

In order to further enhance the attractiveness and interest-generating capability of printed card 21, printed card 21 is formed from any desired material having any desired color. In this way, added interest and excitement can be attained.

Although the creation of printed card 21, as described above, is well known and has been conventionally produced in prior art systems by individuals and small businesses, no individual entity has been capable of also forming printed card 21 with a three-dimensional or pop-up member 22 and is achievable with the present invention. In order to attain this added, dynamic, interest-generating and visually stimulating component to printed card 21, three-dimensional or pop-up member 22 is employed.

In accordance with the present invention, three-dimensional pop-up member 22 is constructed in a generally conventional manner, using die-cutting technology and forming member 22 from paper or cardboard having the requisite weight and thickness to produce the desired effect. However, in the present invention, three-dimensional pop-up member 22 is mounted on a carrier 31 and incorporates a message zone 30 as an integral part thereof.

In addition, three-dimensional pop-up member 22 is removably mounted to carrier 31, using any desired holding system known in the art. Such prior art holding systems include removable adhesive affixation, securement tabs, frangible or breakable webs, and the like. Regardless off which system is employed, the resulting construction provides a three-dimensional pop-up member 22 removably secured to carrier 31 which enables three-dimensional pop-up member 22 to be transported through a conventional printer, enablinse any desired message to be printed in message zone 30.

In this way, three-dimensional pop-up member 22 is produced incorporating any desired message which has been individually created by the operator and directly print ed on member 22. Then, after passage through the printer and the incorporation of the precisely desired personal message in zone 30 of member 22, three-dimensional pop-up member 22 is easily removed from carrier 31 for mounting to printed card 21.

As best seen in FIGS. 1, 3–5 and 7–8, three-dimensional pop-up member 22 incorporates strips 34 and 35 which are employed for securely mounting three-dimensional member 22 to printed card 21. In addition, mounting strips 34 and 35 each incorporate fold lines 36 formed thereon in order to enable the user to easily fold strips 34 and 35 in the precisely desired locations. Preferably, fold lines 36 are scored in order to assist in providing precise folding in the desired locations.

Finally, the construction of three-dimensional pop-up member 22 is completed by incorporating adhesive zones 37 on elongated mounting strips 34 and 35 at the precisely required locations. Adhesive zones 37 may comprise any desired construction which will impart adhesive capabilities to zones 37.

In accordance with well known techniques, adhesive zones 37 may incorporate an adhesive layer over which a protective strip is placed which protects the adhesive layer until mounting of three-dimensional pop-up member 22 is desired. Alternatively, a dried adhesive can be positioned on zones 37 which can be activated by applying moisture thereto to attain the desired adhesive affixation. In addition, any alternate method can be employed to provide the requisite adhesive in zones 37. Regardless of which technique is used, zones 37 incorporate adhesive means contained therein in order to enable three-dimensional pop-up member 22 to be quickly and easily affixed to printed card 21 in the precisely desired location and manner.

In order to provide the desired results, three-dimensional pop-up member 22 is securely affixed to printed card 21 in the precisely desired location which will produce the desired effect of enabling three-dimensional pop-up member 22 to be folded with front panel 23 and rear panel 24, when desired, as well as fully erected and displayed as a three-dimensional pop-up configuration, whenever front panel 23 is pivoted away from rear panel 24 in an opening manner. In order to assist in the mounting process, location defining markings 38 are preferably printed on panels 23 and 24 of card member 21 to define the precise location for the placement of adhesive zones 37 of three-dimensional pop-up member 22.

By incorporating markings 38 to define the precise location for securing adhesive zones 37 of pop-up member 22 to panels 23 and 24 of card member 21, added assurance is provided that the precisely desired location of pop-up member 22 is attained. In this way, added assurance is provided that the individually created three-dimensional printed display system of the present invention produces a product consistent with commercially produced quality standards.

As is evident from the foregoing detailed disclosure, three-dimensional pop-up member 22 may comprise any configuration, size, or shape, desired by the manufacturer. The only requirement is that three-dimensional pop-up member 22 incorporate the elements detailed above to enable the individual or small business owner to create a pop-up member 22 with an individual message incorporated thereon. If desired, pop-up member 22 may incorporate indicia, designs, characters, etc. during its original production in order to further expand upon a particular configuration for a message to be delivered.

Regardless of the presentation of three-dimensional pop-up member 22, the present invention provides three-dimensional pop-up member 22 which is removably mounted to carrier 31 in order to enable three-dimensional pop-up member 22 to be passed through a conventional printer, thereby allowing any desired message to be printed thereon. However, the actual passage of three-dimensional pop-up member 22 through a conventional printer is not a requirement of the present invention, and the desired message can be formed on member 22 in any alternate process.

By referring to FIGS. 9–32, along with the following detailed disclosure, the construction and operation of further alternate embodiments of the present invention can best be understood. In each of these embodiments, three-dimensional, pop-up, and mechanical displays detailed therein are each individually created by the user with any personalized or desired message, information, indicia, image, etc. printed on the display in the precisely desired locations. In this way, individuals and small businesses are able to substantially increase the impact of a wide variety of products employed by these individuals.

In FIGS. 9–15, one preferred construction for attaining a three-dimensional printed display is provided. In this embodiment, mechanically movable elements are detailed, with the movable elements and the holder for the elements incorporating any desired message, indicia, symbol, etc. printed thereon by the user. In addition, the creation of an entire compilation of such three-dimensional mechanical display members in a book is also disclosed.

In order to attain a three-dimensional, mechanical, printed display constructed on an individual basis with personalized messages incorporated thereon, three-dimensional printed display 20 preferably comprises preformed sheets 40, incorporating a top surface 41 (FIG. 9) and a bottom surface 42 (FIG. 11). In addition, top surface 41 of sheet 40 incorporates message receiving zones 43 and 44 and, preferably, comprises fold lines or score lines for enabling sheet 40 to be easily folded into quarters or four segments. In the preferred embodiment, sheet 40 also incorporates an elongated slot 45 separating two of the segments forming sheet 40. Finally, sheet 40 is constructed with a first group of slots 46 formed in one segment of sheet 40 and a second group of slots 47 formed in a second segment of sheet 40.

In the preferred embodiment, a plurality of sheets 40 and a plurality of preformed mechanical activating arm assembles 48 and 49 are supplied to a user in order to enable the user to construct any desired three-dimensional printed display 20 in accordance with this invention. Activating arm assembly 48 is constructed for cooperating with slots 46, while activating arm assembly 49 is constructed for cooperating with slots 47.

As with the embodiments detailed above, any desired message created by the user may be inserted in message receiving zones 43 and 44. Once the message has been developed, sheet 40 is preferably passed through a suitable printer in order to place the desired message, information, indicia, image, etc. directly in zones 43 and 44.

In addition to providing precut and easily assembled sheets 40 along with the requisite activating arm assemblies 48 and 49, the three-dimensional printed display 20 of this embodiment of the present invention also incorporates a plurality of preformed mechanically activatable members 50 and 51 removably mounted to a suitable carrier 31, as described above in relationship with three-dimensional pop-up members 22. In this embodiment, for exemplary purposes only, mechanically activatable members 50 and 51 are depicted as a rabbit and a frog. However, any desired animal, design, character, etc. can be employed with equal efficacy.

Preferably, members 50 and 51 are constructed with surfaces or zones formed therein for receiving any desired printed message, indicia, symbol, information, etc. directly thereon. As with the embodiment detailed above, once the desired message has been formulated for placement in the precisely desired zone or surface of members 50 and 51, carrier 31 is passed through a suitable printer in order to allow the precisely desired message, symbols, indicia, etc. to be printed directly on members 50 and 51.

Once sheet 40 has been constructed with the desired message placed in message zones 43 and 44 and mechanically activated members 50 and 51 have been passed through a printer in order to receive the desired message, indicia or symbols printed thereon, full assembly of the three-dimensional printed display 20 of the present invention is ready to be achieved.

In this regard, sheet 40 is inverted in order to attain easy access to bottom surface 42 and activating arm assembly 48 is inserted through cooperating slots 46 of sheet 40. Using a generally conventionally structure, activating arm assembly 48 is comprises elongated strip 55 to which two, separate, movable finger members 56 and 57 are secured. In the preferred assembly, finger members 56 and 57 are inserted through separate slots 46, while the distal end of elongated strip 55 is inserted through the remaining slot 46. Activating arm assembly 49 is constructed in a substantially identical manner and is assembled in cooperating engagement with slits 47 in the same manner.

Once activating arm assemblies 48 and 49 are inserted through cooperating slots 46 and 47, final construction of sheet 40 is achieved. In this regard, sheet 40 preferably incorporates a preformed adhesive zone 58 and 59 formed on two adjacent segments of sheet 40. As shown in FIG. 12, sheet 40 is folded in half so as to bring the portions of sheet 40 having no adhesive zone 58 or 59 into contacting, overlying, secure engagement with the portions of sheet 40 incorporating adhesive zones 58 and 59. Once in this folded, overlying interengaged position, sheet 40 is securely affixed to itself, due to adhesive zones 58 and 59, sandwiching and locking activating arm assemblies 48 and 49 therein.

As depicted in FIGS. 12, 13, and 14, fingers 56 and 57 of activating arm assemblies 48 and 49 protrude through the slots with which these fingers cooperate, with a portion of strip 55 extending out of the remaining cooperating slot. As is well known in the art, by moving the extending portion of strip 55, cooperating movement of fingers 56 and 57 is achieved, as well as any object affixed thereto.

Three-dimensional printed display 20 of this embodiment is completed by securely affixing the desired mechanically activating member 50 and 51 to the cooperating activating arm assemblies associated therewith. This is shown in FIGS. 13 and 14. In order to enable mechanically activating members 50 and 51 to be quickly and easily secured to fingers 56 and 57, for providing the desired mechanical activation, arm assembles 48 and 49 each incorporate adhesive zones formed at the terminating ends of fingers 56 and 57. In this way, mechanically activating members 50 and 51 are quickly and easily affixed in a precisely desired location to the activating arm assemblies by merely securing members 50 and 51 to the appropriate pre-glued zones of arm assemblies 48 and 49. As discussed above, adhesive zones may comprise any desired construction deemed most appropriate for attaining the desired secure affixation and holding interengagement of members 50 and 51 to arm assemblies 48 and 49.

Once mechanically activating members 50 and 51 are secured in the precisely desired positions, three-dimensional printed display 20 of the present invention is ready for use. As is evident to one of ordinary skill in the art, the use of two mechanically activated members on a single sheet 40 is disclosed merely for exemplary purposes. If desired, one mechanically activated member can be mounted to sheets 40, while the remaining panels of sheet 40 can be employed for receiving any desired printed message. Furthermore, alternate construction and operational details can be widely varied, without departing from the scope of this invention.

In FIG. 15, a further alternate embodiment of this invention is shown. In this embodiment, a plurality of preconstructed three-dimensional printed display members 20 are interconnected with each other to form a book incorporating three-dimensional activating means associated therewith. By employing a wide variety of various mechanically activated members 50 and 51 in association with sheets 40, a wide variety of objects, along with any desired message, symbol, figures, etc. is printed in the appropriate accommodating sections of three-dimensional printed display 20. As a result, a wide variety of unique, exciting and interesting books or stories can be created by an individual using this embodiment or alternate embodiments of the present invention to attain the desired professional, high quality three-dimensional printed display results achievable with the present invention with the individualized messages incorporated thereon.

In FIGS. 16–32, further alternate embodiments of the present invention are fully detailed. In each of these embodiments, a three-dimensional printed display 20 is attained in a manner substantially similar to the three-dimensional printed displays detailed above. These further alternate embodiments are provided as further examples of the wide variety of constructions that can be achieved employing the unique, individualized printed construction of this invention.

In each of the embodiments depicted in FIGS. 16–32, a self-standing, three-dimensional object is attained as the three-dimensional printed display 20. As a result, although each of the objects may incorporate a plurality of components associated therewith, the resulting product comprises a self-standing, three-dimensional object on which all exposed surfaces thereof incorporate any desired personalized message, display, symbol, information, etc.

By employing the present invention, these three-dimensional objects are constructed in a wide variety of alternate ways, presenting a precisely desired visual impression. However, regardless of the information displayed on the printable surfaces thereof, each of these embodiments enables individuals and business people to construct three-dimensional display items heretofore unattainable prior to the present invention.

In addition to detailing in FIGS. 16–32 several alternate three-dimensional printed display objects achievable with the present invention, the variety of objects shown herein merely establishes examples of the numerous alternate objects and construction arrangements that can be achieved using the present invention. However, by referring to FIGS. 16–32, along with the following detailed disclosure, the construction of these alternate embodiments becomes readily apparent, as well as the wide variety of further alternate constructions that can be achieved using the teaching of this invention.

In FIGS. 16–19, a unique bag assembly is depicted which is totally created by an individual or small business with all visible surfaces thereof printed with any desired message, symbol, indicia, etc. Although FIGS. 16–19 depict the entire construction of this bag assembly as individually created by the user, it is readily apparent that the components incorporated to form the bag into a unique three-dimensional display can be the sole items printed by the user, with a conventional or decorative or undecorated bag being employed by the user, instead of a self-created bag. However, regardless of the construction employed by the user, the concepts and teaching of this invention are employed.

As shown in FIG. 16, in this embodiment, carrier sheet 55 is constructed for being passed through a conventional printer in order to enable the components associated with carrier sheet 55 to be printed with any desired indicia, message, information, etc. positioned in the available print-receiving surfaces thereon. In this embodiment, a bag forming member 56 is removably mounted to carrier sheet 55 in association with carrying handles 57,57, arm members 58,58, a head forming member 59, and feet forming member 60. Each of these components are removably affixed to carrier sheet 55 and incorporate, where necessary, fold lines and adhesive zones 61 constructed in the manner detailed above with the alternate embodiments of the present invention.

As depicted in FIG. 16, bag forming member 56, as well as carrying handles 57,57, arm members 58,58, head member 59, and feet forming member 60 are all constructed with substantially the entire surfaces thereof being available for receiving any desired indicia, messages, designs, logos, etc. In this way, the construction of this unique, visually stimulating, visually exciting product holding bag is created in a wide variety of manners, custom made for the particular use or purpose sought by an individual or small business. Alternatively, if desired, portions of these components can be pre-printed with particular visual indicia, designs, or representations while still allowing the remaining portions to incorporate any desired printed message or indicia of the user.

Figure 17:
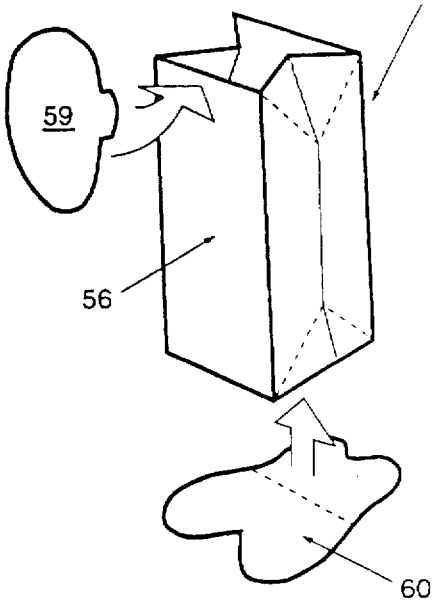
FIGS. 17–19 are perspective views of the three-dimensional display of FIG. 16 in various stages of assembly.
Figure 18:
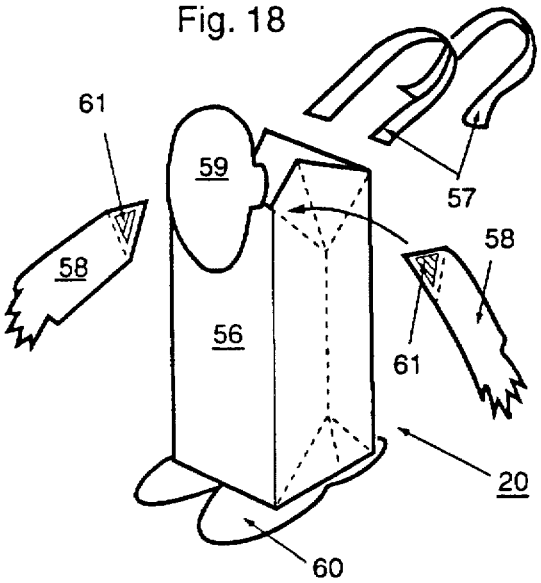
Figure 19:
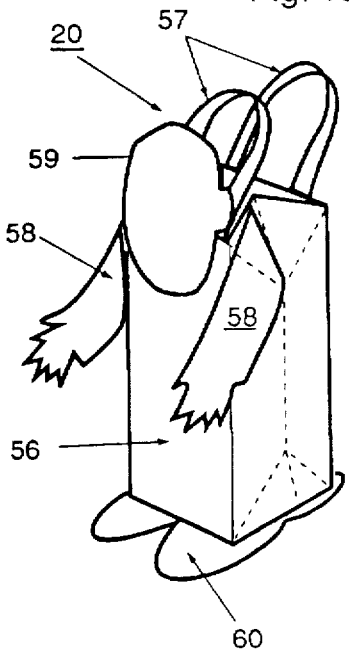

Once carrier sheet 55 has been passed through a printer with the precisely desired messages, indicia, symbols, logos, etc. are printed thereon in the appropriate locations, the printed components are removed from carrier sheet 55 and assembled into a unique, visually stimulating and exciting product holding bag or container. The assembly of this unique bag is depicted in FIGS. 17–19.

Once fully assembled, the resulting product holding container/bag achieves a unique and exciting visual presentation for use by an individual or small business to attain any desired promotion or visual impact, with the precisely desired visual images, message, symbols, indicia, etc. printed directly on the components for which such information display is sought. In this way, professional, three-dimensional visually stimulating display items are attained in a manner previously unattainable by individuals or small businesses.

In FIGS. 20–25, two alternate constructions for three-dimensional printed displays 20 of the present invention are depicted. As with the previous embodiments, each of these three-dimensional printed display 20 is completely producible by an individual or small business with any desired information, indicia, logo, design, etc. printed on the outer visible surfaces thereof, prior to assembly of the three-dimensional printed display 20.

Figure 22:
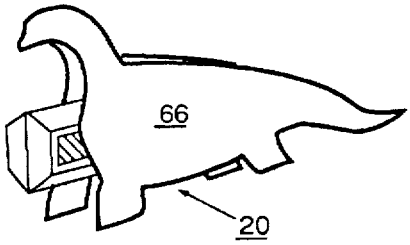
Figure 23:
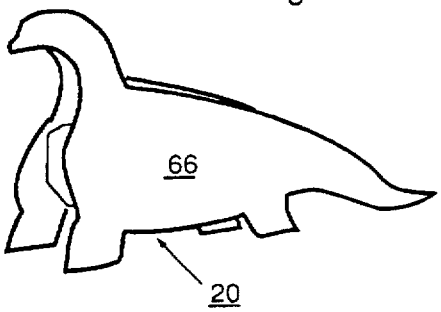
Figure 24:
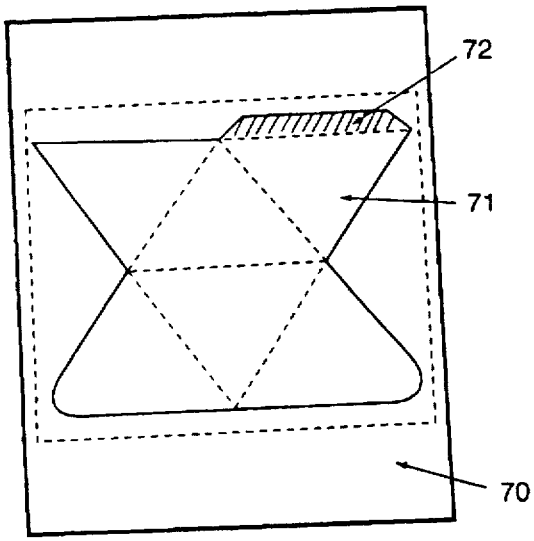
FIG. 24 is a top plan view of a carrier sheet incorporating the planar display of a pyramid-forming member mounted thereto for forming the three-dimensional display assembly.
Figure 25:
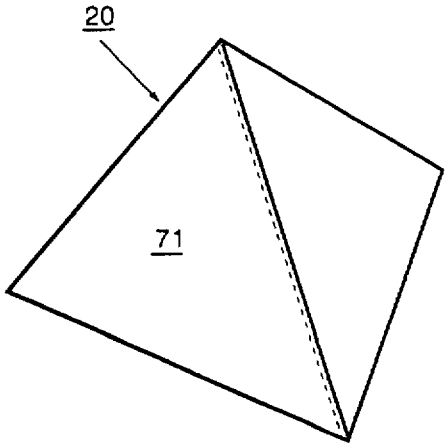
FIG. 25 is a perspective view of the fully assembled pyramid of FIG. 24, representing the printed display.

In FIGS. 20–23, the construction of a three-dimensional object in the form of a dinosaur is depicted, while FIGS. 24 and 25 depict the construction of a pyramid-shape three-dimensional object. Of course, numerous other objects, animals, characters, etc. can be achieved in a similar manner.

Figure 20:
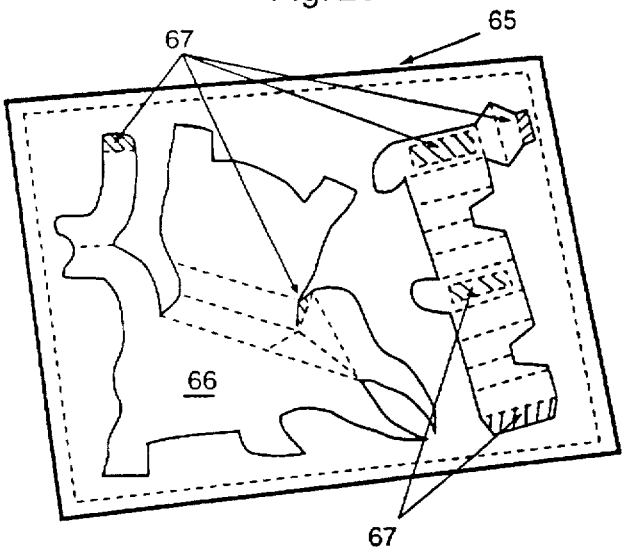
FIG. 20 is a perspective view of a further alternate embodiment of the printed display of the present invention wherein a three-dimensional animal structure is depicted in planar form prior to assembly, mounted on a carrier sheet.
Figure 21:
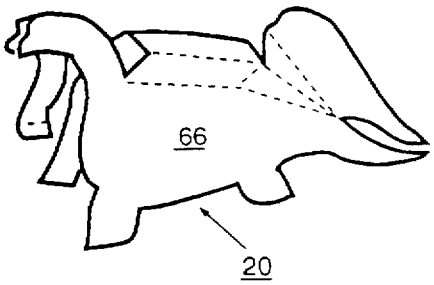
FIGS. 21–23 are perspective views depicting the three-dimensional display assembly of FIG. 20 in various stages of assembly.

In the embodiment depicted in FIG. 20, carrier sheet 65 is constructed incorporating all of the components necessary for constructing the desired three-dimensional animal-shaped member depicted thereon. In this embodiment, carrier sheet 65 incorporates a dinosaur forming member 66 which is constructed in completely planar form with all of the requisite fold lines necessary to construct a three-dimensional dinosaur incorporated therein. In addition, each of these lines are preferably scored in order to provide ease of folding and assembly. Furthermore, as with the embodiments detailed above, dinosaur member 66 also incorporates adhesive zone 67 incorporated thereon in order to assure the complete folded, integrated, self-standing construction desired for the final product.

As with the embodiments detailed above, dinosaur forming member 66 incorporates exposed surfaces on which any desired printed message, information, display, logo, indicia, etc. can be printed by the user. By first designating the precise information sought to be printed on dinosaur forming member 66 and then passing carrier sheet 65 through a suitable printer, the precisely desired information can be placed on dinosaur forming member 66 in the precisely desired locations. Then, once dinosaur forming member 66 is completely printed with the desired message, information, designations, etc., dinosaur forming member 66 is removed from carrier sheet 65 and assembled in the manner shown in FIGS. 21–23.

In the preferred construction, in order to assure that the three-dimensional, self-standing, easily assembled dinosaur 66 is achieved by employing carrier sheet 65 of the present invention, a support member 68 is formed on carrier sheet 65 incorporating the requisite adhesive zone 67 and fold lines formed therein in order to assure ease of assembly in the desired manner.

As depicted in FIG. 22, support member 68 is folded into the required shape for insertion within the sides of dinosaur forming member 66, with the adhesive zones incorporated on a support member 68 being employed for assuring secure, interengagement of member 68 within dinosaur member 66, thereby providing a self-standing, easily erectable, dinosaur appearing three-dimensional member 66 as shown in FIG. 23. In this way, any desired message, information, indicia, logo, etc. is printed by the user on the visible sides of dinosaur 66, with dinosaur 66 being quickly and easily assembled into the final three-dimensional printed display 20 of the present invention.

In FIG. 24, carrier sheet 70 is depicted incorporating a pyramid-forming member 71 removably affixed thereto. Pyramid member 71 incorporates adhesive zones 72 for assuring the secure, fully erected, self-standing pyramid 71 when in its final assembled form, as shown in FIG. 25.

By employing this embodiment of the present invention, carrier sheet 70 is passed through a conventional printer in order to enable the user to place any desired message, indicia, logo, etc. on any portion of pyramid-forming member 71, in the manner detailed above. Then, once pyramid-forming member 71 has been printed with the desired message or information placed thereon, pyramid-forming member 71 is removed from carrier sheet 70 and assembled into the final pyramid configuration depicted in FIG. 25. In this configuration, the three-dimensional printed display member 20 in the form of pyramid 71 is capable of providing the user with a unique, visually stimulating, display which individuals and small businesses have been incapable of providing in a commercially feasible manner prior to this invention.

Figure 26:
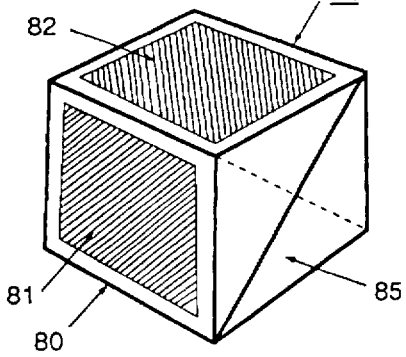
FIG. 26 is a perspective view of an alternate embodiment of the three-dimensional display assembly of the present invention depicted in this embodiment as a self-standing cube-shaped member.
Figure 27:
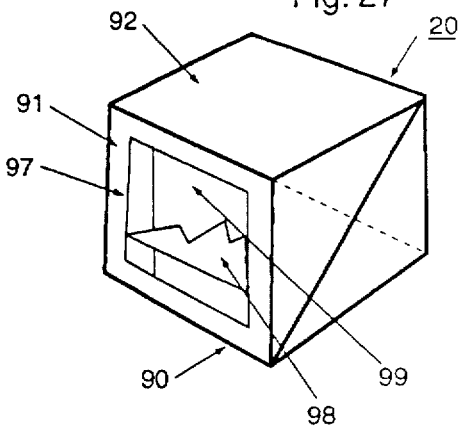
FIG. 27 is a further alternate embodiment of a three-dimensional printed display of the present invention wherein said display comprises a self-standing cube-shaped component incorporating a diorama image formed therein.

In FIGS. 26 and 27, two alternate embodiments of an individually produced, three-dimensional, printed display 20 of the present invention are depicted. In each of these embodiments, three-dimensional printed display 20 comprises self-standing cube-shaped members 80 and 90.

As shown in FIG. 26, cube member 80 is constructed as a substantially closed cube structure, with a front surface 81, a top surface 82, a bottom surface 83, a rear surface 844, and side surfaces 85 and 86. Each surface comprises substantially flat planar shapes on which any desired message, logo, design, indicia, etc. can be printed by the user. As is fully detailed below, side surfaces 85 and 96 are constructed for being folded, in order to store cube 81 when not in use. Consequently, the remaining four surfaces represent the principal surfaces upon which any desired printed message usually appears. However, if desired, the side surfaces 85 and 86 of cube 80 can incorporate printed indicia thereon if deemed appropriate by the user.

Cube member 90 is constructed in a substantially identical manner to cube 80, with a front surface 91, a top surface 92, a bottom surface 93, and a rear surface 94. These surfaces comprises the principal surfaces on which printed messages, indicia, logos, designs, etc. are printed by the user. However, side surfaces 95 and 96 may be printed upon if so desired.

In this embodiment, front surface 91 comprises a cut-out zone 97 forming a substantial portion of surface 90, thereby establishing a visually appearing window frame, peripherally surrounding cut-out zone 97. By providing cut-out zone 97, the interior of cube 90 becomes visible.

By employing the construction depicted in FIG. 27 for cube 90, a unique, visually distinctive dioramic presentation is achieved, with any desired visual image, message, indicia, logo, etc. presented on the components thereof. In this embodiment, diorama-forming panels 98 and 99 are employed to present the unique, visually distinctive, three-dimensional image within cube 90. By employing this unique construction, any desired message, indicia, logo, etc. can be printed on the surfaces of cube 90 as well as on the diorama components 98 and 99 mounted within cube 90. As a result, individuals and small businesses are capable of achieving unique, visually attractive, and distinctive three-dimensional printed display 20 with any desired information contained thereon without incurring the expenses of a commercially produced product.

Figure 28:
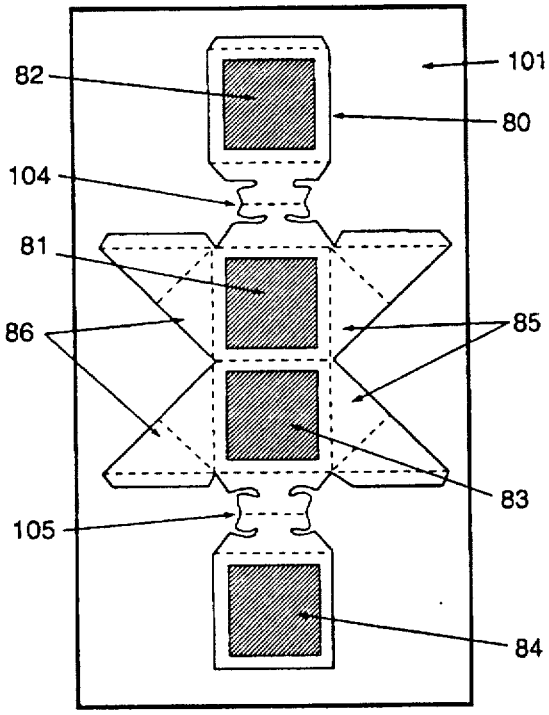
FIG. 28 is a top plan view depicting a carrier sheet incorporating a removably mounted, unfolded, planar panel assembly required to construct the cube of FIG. 26.

As shown in FIG. 28, cube member 80 is preferably formed using conventional die-cut techniques from material having sufficient thickness to provide the strength and rigidity required for forming cube member 80. In addition, in the preferred construction, cube 80 is removably mounted to carrier sheet 101 in order, to enable surfaces 81, 82, 83, 84, 85, and 86 to be printed with any message, information, logo, design, indicia, etc. desired by the user.

The desired display message or information is inputted into a computer in the manner detailed above and, once fully prepared, sheet 101 is passed through a suitable printer in order to place the precisely desired message in the proper location on cube 80. Once cube 80 has been printed in the desire manner, cube 80 is removed from carrier sheet 101 and assembled to produce the final three-dimensional printed display 20 of this invention.

Figure 29:
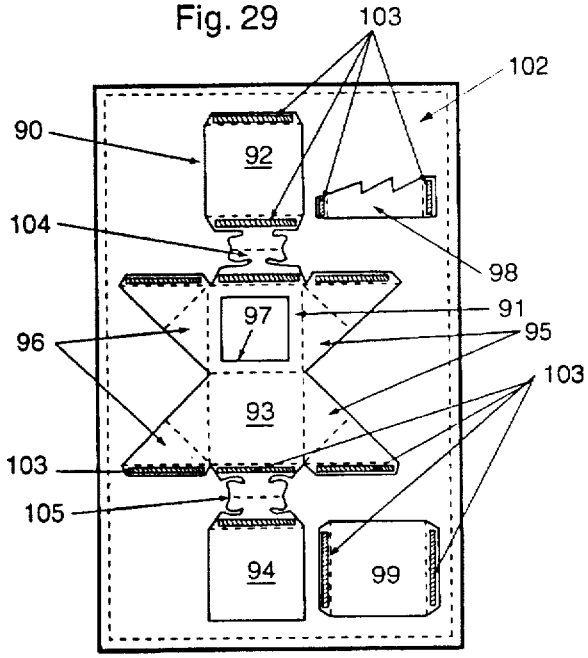
FIG. 29 is a top plan view depicting a carrier sheet incorporating a removably mounted, planar., unfolded panel assembly required to construct the cube of FIG. 27.

Using a virtually identical technique, cube member 90 is printed in the same manner. As shown in FIG. 29, cube member 90 is formed in the manner detailed above in reference to cube 80 and is removably mounted to carrier sheet 102. Using a virtually identical technique, the desired information, messages, logos, indicia, etc. are inputted into a computer and then transferred to the appropriate surfaces of cube 90 by passing carrier sheet 102 through a conventional printer. Once printed in the desired manner, cube 90 is removed from carrier sheet 102 and assembled to attain the desired three-dimensional printed display 20 of this invention.

In this embodiment, as shown in FIG. 29, carrier sheet 102 also incorporates diorama-forming components 98 and 99 which are also printed in the same manner detailed above. Once printed, these elements are then mounted in cube 90 for providing the unique, three-dimensional display through cut-out zone 97.

In FIG. 29, cube 90 is depicted with a plurality of adhesive zones 103 formed on appropriate locations throughout cube 90 and diorama components 98 and 99. Although the incorporation of adhesive zones is not required and the required areas can have adhesive separately applied, the preferred embodiment incorporates adhesive zones 103 in order to assure secure affixation and mounted interengagement of the appropriate sections of cube 90 in the desired manner. Similarly, although not depicted in FIG. 28, similar adhesive zones 103 may be employed with cube 80 in order to assure its secure assembly in a most rapid and convenient manner.

In order to form the unique three-dimensional diorama images in cube 90, background panel 99 is preferably mounted to top surface 92 and bottom surface 93, while intermediate diorama-forming component 98 is mounted between cut-out zone 97 and panel 99. This component can be mounted to cooperating sides 95 and 96 of cube 90, or to front panel 91, using an alternate form.

By positioning the diorama components in the desired manner and securely affixing these components to the accommodating walls of cube 90, a unique three-dimensional image is attained which is readily visible through cut-out zone 97, when cube 90 is in its fully erected position. In this way, once cube 90 has received the precisely desired printed information thereon, cube 90 is ready for providing the individual or small business with a unique visual display completely controlled by the user with the precisely desired message, information, designs, logos, etc. placed thereon.

Figure 31:
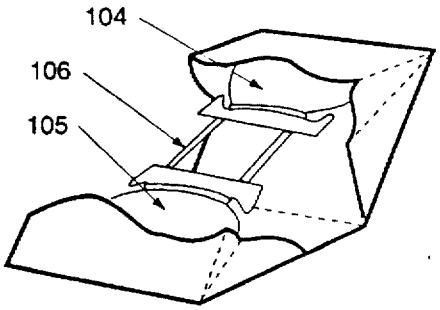
FIG. 31 is a perspective view, partially broken away, of the cube of FIG. 26, depicting its internal construction.

In order to assure that cube members 80 and 90 are maintained in a fully erected position when assembled, each cube member incorporates spring means receiving arm members 104 and 105 integrally formed as part of the cube assembly. Once cube members 80 and 90 have been fully constructed, spring means, such as a rubber band 106, is mounted about arm members 104 and 105, as depicted in FIG. 31. Once mounted, spring means 106 provides the desired force to draw the surfaces of cube members 80 and 90 into its fully erected position. In this way, cube members 80 and 90 are assured of being continuously biased into a fully erected position, with the printed surfaces thereof readily visible to continuously display the message or information printed thereon by the user. As a result, a unique, highly visible, and strikingly advantageous three-dimensional printed display 20 is achieved.

If desired, cube members 80 and 90 may be constructed from material which incorporates a particular background design upon which the message or information desired by the user can be printed. By forming cube 80 and cube 90 from material of this nature, greater visual impact, excitement, and interest can be generated. Although such material may comprise particular background colors, it is also within the scope of the present invention that other printable material, such as holographic or three-dimensional printable material, can be used as a further enhancement of the present invention.

In a still further embodiment of the present invention, cube members 80 and 90 may be constructed as fully assembled products or for assembly by the user, without the user being required to pass the entire cube member through a printer to place the desired information on the surfaces thereof. This is particularly useful in constructions wherein heavier material is desired for cube members 80 and 90, which would be difficult to pass through conventional printers.

Figure 30:
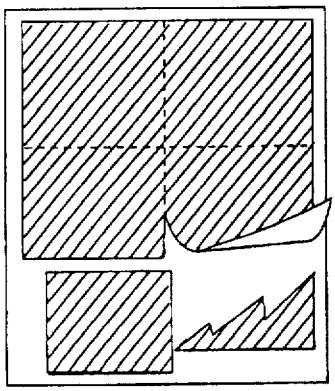
FIG. 30 is a top plan view depicting a plurality of removable panels affixed to a carrier sheet for use in forming printed surfaces for incorporation on the cubes of FIGS. 26 and 27.

In this embodiment, the desired information for placement on cube members 80 and 90 is printed on removable adhesive backed panel members 110, 111, and 112, as depicted in FIG. 30. Each panel member 110 is preferably formed in a precise size and shape conforming to the size and shape of the surfaces of cube members 80 and 90. In addition, panel member 111 is depicted for placement on dioramic component 99, while panel 112 is constructed for placement on dioramic component 98.

Each of the panel members 110, 111, and 112 are constructed with the precisely required size and shape and placed on carrier sheet 115. By employing this embodiment, carrier sheet 115 is passed through a conventional printer, after the desired message, information, indicia, logo, etc. have been inputted into the computer for placement on the panels in the appropriate positions. Once panels 110, 111, and 112 have been printed in the precisely desired manner, the panels are removed from carrier sheet 115 and placed on cube members 80 or 90 in order to construct the desired three-dimensional printed display of this invention.

One of the unique features and attributes of the three-dimensional display of the present invention depicted in FIGS. 26 and 27 is the ability of cube members 80 and 90 to be completely folded into a small, compact, assembly and, when desired, automatically deployed into its fully erect, three-dimensional cube form when only partially opened. As a result of this unique construction and automatic self-erecting assembly, an individually created, printed display member is attained which provided further enhancement and excitement to any recipient.

By referring to FIGS. 32–36, along with the following detailed disclosure, the preferred construction and automatic assembly of cube 80 can best be understood. Although this discussion focuses on cube 80, the discussion has equal applicability to cube 90, which is constructed in a substantially identical manner. Furthermore, variations can be made to the structure detailed herein without departing from the scope of this invention.

Figure 32:
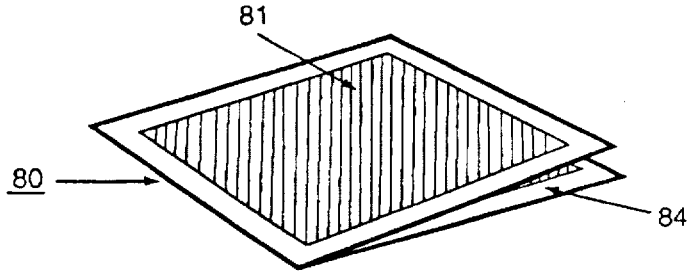
FIG. 32 is a perspective view of the cube of FIG. 26 depicted in a completely folded configuration, visually appearing as a conventional book.

As shown in FIG. 32, cube 80 is depicted in its fully folded, compact, stowable position, wherein side panels 85 and 86 have been folded inwardly and panels 81, 82, 83, and 84 are folded in overlying engagement with each other, forming the compact configuration depicted in FIG. 32. As shown in FIG. 32, this configuration of cube 80 is constructed to represent the visual construction of a conventional book, with panels 81, 82, 83, and 84 appearing as pages of the book.

Figure 33:
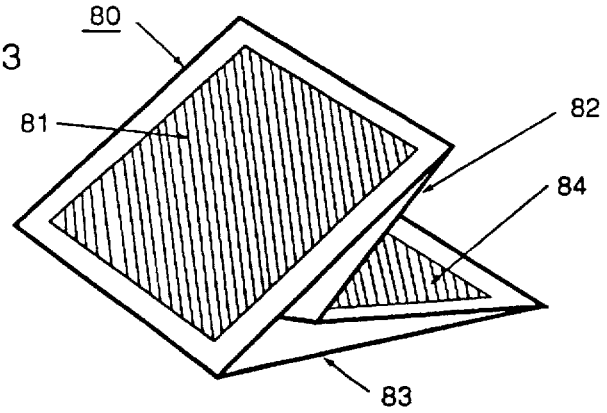
FIG. 33 is a perspective view of the folded cube of FIG. 32 in the process of being opened.

As is evident from FIG. 32, with panel 81 and 82 overlying panel 84 and 83, in a closed, compact manner, an observer of folded cube 80 would easily believe that cube 80 is merely a book having printed material on the surfaces thereof. In FIG. 33, panels 81 and 82 are depicted partially pivoted away from panels 84 and 83, in the general manner one would employ when opening a conventional book or compact folded product assembly.

Figure 34:
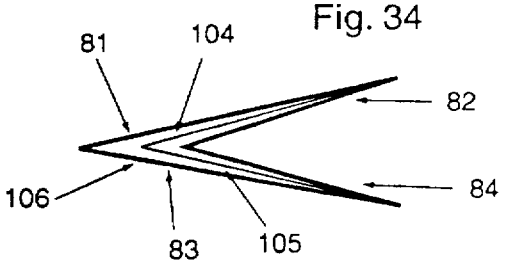
FIGS. 34 and 35 are cross-sectional views depicting the cube of FIG. 32 in alternate stages of opening.

When cube 80 is in its fully folded configuration as depicted in FIG. 32 and is being opened as represented by FIG. 33, spring means 106, preferably in the form of a rubber band affixed to integrally formed arms 104 and 105, provides spring biasing forces which merely draw against panels 82 and 84. As shown in FIG. 34, the actual spring forces exerted by rubber band 106 are merely individually acting upon panels 82 and 84 by drawing against the common edges thereof and arms 104 and 105. In this position, the spring forces are incapable of providing any automatic opening of cube 80.

Figure 35:
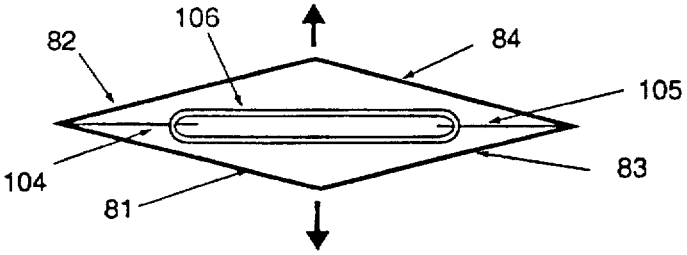
Figure 36:
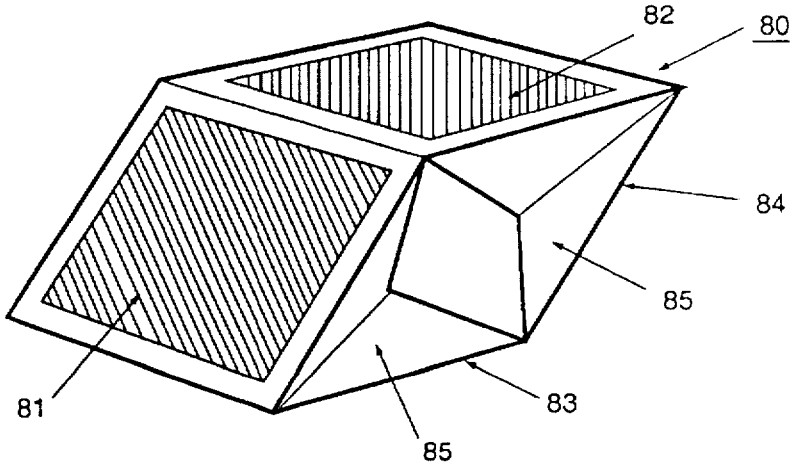
FIG. 36 is a perspective view of the cube of FIG. 32 in the process of being automatically self-erected.

As panels 81 and 82 are pivoted through an arc of about 180°, as depicted in FIG. 35, rubber band 105 becomes capable of effectively exerting its spring forces directly on arms 104 and 105 drawing arms 104 and 105 towards each other. Consequently, once panels 81 and 82 have been arcuately pivoted into a generally fully open, planar configuration, as shown in FIG. 35, the inherent spring force provided by rubber band 106 causes cube 80 to be automatically deployed into its fully constructed, erect, cube shape as depicted in FIG. 26. This automatic movement is depicted by the arrows in FIG. 35, as well as ill FIG. 36, wherein cube 80 is in the process of being automatically deployed into its fully erect configuration.

As a result of this construction, a unique surprise, self-erecting, cube structure is achieved which is capable of being visually configured in the form of a conventional book or folded assembly. Then, as the book or folded assembly is opened for reading the various messages displayed on the panels thereof, the opening of the panels/pages by the user causes cube 80 to be automatically deployed into a fully erect cube shape. This surprising, rapid, automatic, self-constructing capability provides a unique visually enhancing and exciting construction which enables a user to employ the individual printing capabilities of cube 80 to achieve an extremely unique, exciting, printed display heretofore unattainable in any other construction.

Figure 37:
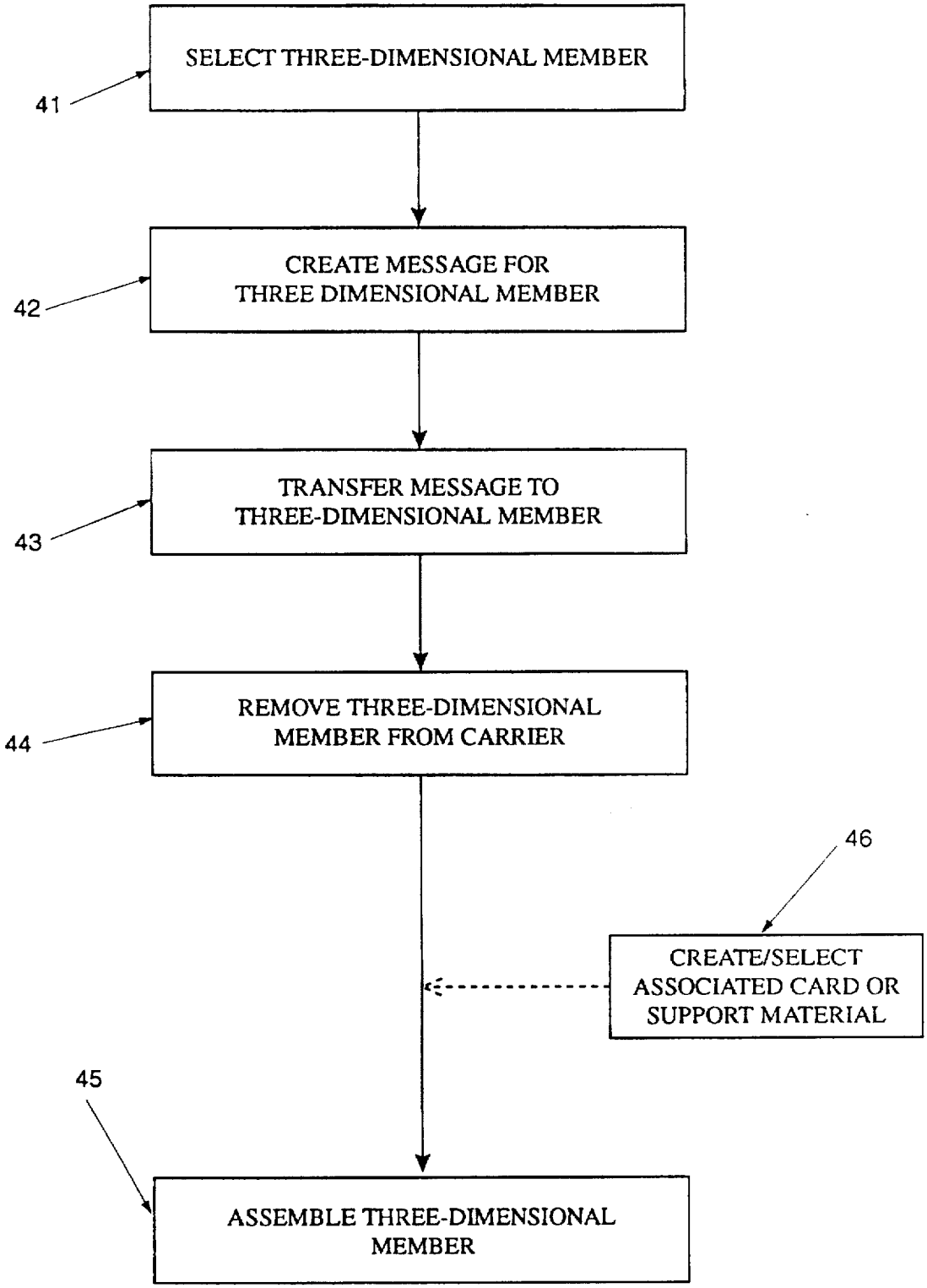
FIG. 37 is a schematic flow diagram depicting the overall method of the present invention.
Figure 38:
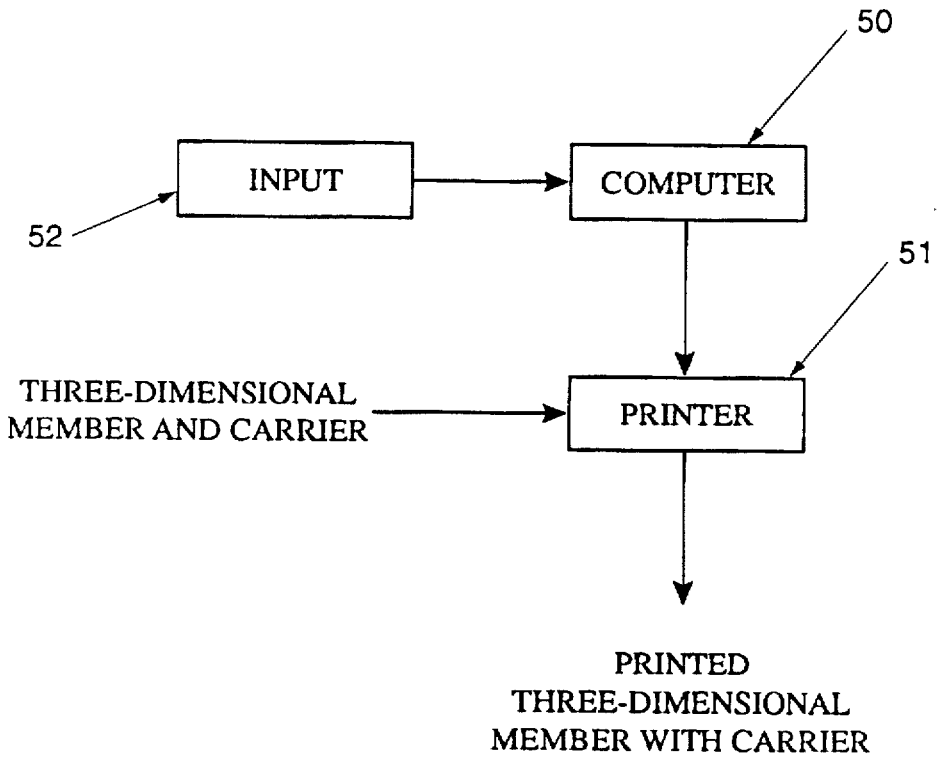
FIG. 38 is a further schematic block diagram detailing additional method steps employed in carrying out the present invention.

By referring to FIGS. 37 and 38, along with the following detailed disclosure, the preferred implementation of the method or process of the present invention can best be understood. Typically, in order to obtain commercial quality, three-dimensional, pop-up, and mechanical displays on an individualized basis, as is attainable with the present invention, the individual or small business operator first selects or creates the particular three-dimensional, pop-up, or mechanical member desired (block 41). In making this determination, the particular three-dimensional, pop-up, or mechanical member is selected based upon its overall characteristics, construction, configuration, etc. which will provide the best display sought by the user.

Once the three-dimensional, pop-up, or mechanical member is selected, the next step employed, as defined in block 42, is the creation of the precisely desired message for incorporation on the pop-up, three-dimensional, or mechanical member. In accordance with the present invention, the particular message may comprise any desired alpha-numeric content, as well as any desired indicia, image, logo, etc. In addition, any desired colors, designs, etc., that are capable of being printed on three-dimensional, pop-up, or mechanical member may be incorporated in the message.

Once the desired message has been created, the message is transferred to the message zone of three-dimensional, pop-up, or mechanical member, as shown in block 43. As detailed above, this transfer step is typically achieved by employing a conventional printer connected to a personal computer. Although the use of a personal computer and printer is preferred as the manner for creating a message and transferring the message to the message zone of the pop-up, three dimensional, or mechanical member, any alternate system or message transfer means can be employed without departing from the scope of this invention.

Once the precisely desired message has been transferred to the message zone of three-dimensional, pop-up, or mechanical member, the three-dimensional, pop-up, or mechanical member is removed from its associated carrier, as shown in block 44. If the particular three-dimensional printed display selected employs a card or support member associated therewith, the particular card or support member is selected and/or, if desired, created/printed with any desired message, image, indicia, etc. thereon (Block 46).

The final step in achieving the commercial grade three-dimensional printed display is realized by assembling the printed three-dimensional, pop-up, or mechanical member as required by the particular embodiment selected. Once completed, a high quality, three-dimensional printed display is realized and a heretofore previously unattainable goal is attained. By employing this invention, an individual or small business is able to create any desired quantity of three-dimensional printed displays providing added excitement and interest to such products.

Although alternate systems can be employed to produce a three-dimensional, printed member 20 which incorporates an individually produced message formed thereon, the preferred system employs the use of a generally conventional personal computer and a cooperating printer capable of producing the desired indicia on the three-dimensional, pop-up, or mechanical member, as well as any card or support member associated therewith. As shown in schematic block diagram of FIGURE 38, the preferred embodiment of the present invention employs a computer 50 which is connected to a printer 51.

Computer 50 comprises a conventional, state-of-the art personal computer which has been programmed to enable the operator to designate, through a menu driven process, the particular size and shape of the three-dimensional, pop-up, or mechanical member selected and the size and shape of the available message zone associated therewith. In this way, the operator is capable of efficiently formulating the desired message for incorporation on three-dimensional, pop-up, or mechanical member with assurance that the size of the lettering or the indicia employed is capable of being printed within the dimensions of the available message zone.

In employing the individualized, three-dimensional printing display system of the present invention, the operator's input 52 is transmitted to computer 50 and stored in the memory of computer 50, along with the size and shape of the selected three-dimensional, pop-up, or mechanical member. Once the entire message input 52 has been transmitted to computer 50, the operator places the desired three-dimensional, pop-up, or mechanical member and its associated carrier in printer 51, ready for transferral through printer 51, upon activation thereof.

When ready, the operator initiates computer 50 which transmits a signal to printer 51 to draw the three-dimensional, pop-up, or mechanical member and carrier through printer 51 while simultaneously printing the desired message in the available message zone. Once the printing process has been completed, printer 51 delivers, as its output, a fully printed three-dimensional, pop-up, or mechanical member with its associated carrier 31. In this configuration, the three-dimensional, pop-up, or mechanical member incorporates the precisely desired message fully printed in its message zone, enabling the resulting three-dimensional, pop-up, or mechanical member to be removed from its carrier and assembled, erected, or positioned with an associated card or support member to produce the desired resulting product.

It will thus be seen that the objects set forth above, among those made apparent from the preceding description, are efficiently attained and, since certain changes may be made in the above constructions, as well as in the above method steps without departing from the scope of the present invention, it is intended that all matter contained in the above description or shown in the accompanying drawings shall be interpreted as illustrative and not in a limiting sense. It is also to be understood that the following claims are intended to cover all of the generic and specific features of the invention herein described, and all statements of the scope of the invention which, as a matter of language, might be said to fall there-between.

Having described my invention, what I claim as new and desire to secure by letters patent is:

1. A process for enabling any individual to independently produce printed material incorporating a three-dimensional image forming member on which any individualized, specific, desired message is printed, said process comprising the steps of:

A. selecting a card display member having a desired size and shape and incorporating at least a first panel and a second panel, said first panel being arcuately pivotable relative to said second panel;

B. printing any specific desired message on the card member to provide a desired information/effect thereto;

C. selecting a three-dimensional image forming member assembly, said assembly comprising a. a support carrier constructed in a substantially planar form, b. a pre-printed three-dimensional image forming member constructed in a substantially planar form, removably mounted to the support carrier, and incorporating therewith a message receiving zone and support strips for enabling the affixation of the three-dimensional image forming member to the card display member and c. holding means 1. cooperatively associated with the pre-printed three-dimensional image forming member and the support carrier, 2. securely retaining the pre-printed three-dimensional image forming member to the support carrier when desired, and 3. enabling the removal of the pre-printed three dimensional image forming member in its entirety from the support carrier, when desired;

D. developing a desired, specific, individualized message for placement on the pre-printed three-dimensional image forming member;

E. printing the specific, individualized desired message onto the message receiving zone of the pre-printed three-dimensional image forming member;

F. removing pre-printed three-dimensional image forming member completely from the support carrier and returning the support carrier to a location spaced away from the card display member; and G. mounting pre-printed the three-dimensional image forming member on the card display member by employing the support strips cooperatively associated therewith, thereby producing an individually created three-dimensional, pop-up image mounted directly to a card display member for cooperative association with the arcuate movement of the first panel and the second panel.

2. The process defined in claim 1 wherein said support strips are further defined as beings integrally affixed to the pre-printed three-dimensional image forming member, forming an integral part thereof, with said support strips further comprising fold designating lines formed thereon for enabling the pre-printed three-dimensional image forming member to be easily assembled in the precisely desired manner.

3. The process defined in claim 2 wherein said fold designating lines are further defined as being scored in order to assure ease of folding in the precisely desired locations.

4. The process defined in claim 2, wherein said support strips are further defined as comprising adhesive zones formed thereon for affixation to the cooperating card display member, with said adhesive zones incorporating fastening means contained therein for assuring ease of securement of said support strips to the card display member.

5. The process defined in claim 4, wherein said fastening means of the adhesive zones is further defined as comprising one selected from the group consisting of dry adhesives and self-affixing adhesive films.

6. The process defined in claim 4, wherein the first panel and the second panel are further defined as incorporating indicia printed thereon for designating the precise location on which the fastening means of the adhesive zones of the support means should be placed for properly affixing the three-dimensional image forming member to the display member.

7. The process defined in claim 1, wherein the holding means is formed between the support carrier and the pre-printed three-dimensional image forming member for securely retaining the pre-printed three-dimensional image forming member affixed to the support carrier for printing a desired message onto the message receiving zone of the pre-printed three-dimensional forming member and providing the easy removal of the pre-printed three-dimensional image forming member from the support carrier after printing the desired message.

8. The process defined in claim 1, wherein the holding means is further defined as comprising one selected from the group consisting of adhesives, mechanical fasteners, frangible webs, and securement tabs.

* * * * *